US009822563B2

(12) United States Patent
Jones et al.

(10) Patent No.: US 9,822,563 B2
(45) Date of Patent: Nov. 21, 2017

(54) METHOD AND APPARATUS FOR INSTALLING CUTTING EDGES ON A V-BLADE PLOW

(71) Applicant: Douglas Dynamics, L.L.C., Milwaukee, WI (US)

(72) Inventors: Tyler Jones, Appleton, ME (US); Matthew Kaminecki, Milwaukee, WI (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 0 days.

(21) Appl. No.: 14/953,580

(22) Filed: Nov. 30, 2015

(65) Prior Publication Data

US 2016/0076285 A1 Mar. 17, 2016

Related U.S. Application Data

(62) Division of application No. 13/777,480, filed on Feb. 26, 2013, now Pat. No. 9,200,418.

(51) Int. Cl.

| | |
|---|---|
| ***E01H 5/06*** | (2006.01) |
| ***E05D 5/14*** | (2006.01) |
| ***E05D 3/02*** | (2006.01) |

(52) U.S. Cl.

CPC ..... *E05D 5/14* (2013.01); *E01H 5/065* (2013.01); *E01H 5/066* (2013.01); *E05D 3/02* (2013.01);

(Continued)

(58) Field of Classification Search

CPC ..... E01H 5/06; E01H 5/061; E01H 5/065; E01H 5/066; E05D 11/06; E05D 11/00; E05D 11/0054; E05D 2011/0063

(Continued)

(56) References Cited

U.S. PATENT DOCUMENTS

| | | | |
|---|---|---|---|
| 79,606 | A | 7/1868 | Smith |
| 222,036 | A | 11/1879 | Graff |

(Continued)

FOREIGN PATENT DOCUMENTS

| | | |
|---|---|---|
| JP | 2-311607 | 12/1990 |

OTHER PUBLICATIONS

Assembly Instruction sheets for The Boss Snowplow Snow Catcher Kit, published prior to 2003.

*Primary Examiner* — Matthew D Troutman

(74) *Attorney, Agent, or Firm* — Wood Herron & Evans LLP

(57) ABSTRACT

For a V-plow having a pair of blades hinged together along inboard ends of the blades at a hinge, a gauge on a lower end of the hinge having a spacer, the spacer having a thickness in a direction generally transverse to a longitudinal axis of the V-plow corresponding to a desired minimum spacing between inboard ends of a pair of cutting edge plates to be installed on the blades, a method of installing the cutting edge plates on the blades is provided. The method comprises positioning one of the cutting edge plates along a lower edge of one of the blades so that the inboard end of the one cutting edge plate abuts one side of the spacer, securing the one cutting edge plate to the one blade, positioning the other cutting edge plate along a lower edge of the other blade so that the inboard end of the other cutting edge plate abuts the other side of the spacer, and securing the other cutting edge plate to the other blade.

10 Claims, 10 Drawing Sheets

(52) U.S. Cl.
CPC ..... *Y10T 16/551* (2015.01); *Y10T 29/49826* (2015.01)

(58) Field of Classification Search
USPC ..... 248/200, 205.1, 213.1, 227.2, 304; 16/223, 374, 375
See application file for complete search history.

(56) References Cited

U.S. PATENT DOCUMENTS 423,730 A * 3/1890 Charlton ..... F16B 37/045 24/DIG. 53
1,621,040 A 11/1925 Thompson
1,997,001 A 4/1935 Lamb
2,229,053 A 1/1941 De Vaux
2,428,131 A 9/1947 Uebelhoer
2,468,950 A 5/1949 Wiedman
2,590,143 A 3/1952 Adams, Jr. et al.
2,904,904 A 9/1959 Krueger
3,157,009 A 11/1964 Ulrich
3,333,294 A * 8/1967 Warner ..... E05D 11/06 16/375
3,378,084 A 4/1968 Ulrich
3,431,590 A * 3/1969 Anderson ..... E05D 11/00 16/223
3,512,589 A 5/1970 Ulrich
3,526,979 A 9/1970 Ladewski
3,531,175 A 9/1970 Snyder
3,803,733 A 4/1974 Ramsey
3,898,753 A 8/1975 Kinnunen
4,074,448 A 2/1978 Niemela
4,135,583 A 1/1979 Becker
4,159,584 A 7/1979 Niemela
4,346,928 A 8/1982 Towsend
4,384,620 A 5/1983 Uchida et al.
4,597,202 A 7/1986 Weeks
4,899,472 A 2/1990 Winter
5,109,992 A * 5/1992 Miller ..... A47F 5/0823 211/59.1
5,511,837 A * 4/1996 Dempsey ..... E05C 17/025 16/319
6,108,946 A 8/2000 Christy
6,134,814 A 10/2000 Christy et al.
6,170,178 B1 * 1/2001 Christy ..... E01H 5/06 172/272
6,240,658 B1 6/2001 Knutson et al.
6,253,470 B1 7/2001 Depies et al.
6,412,199 B1 7/2002 Quenzi et al.
6,813,848 B2 11/2004 Ortamala
7,437,839 B2 10/2008 Christy et al.
2006/0123669 A1 6/2006 Christy et al.
2008/0235996 A1 10/2008 Evans et al.
2009/0230267 A1 * 9/2009 Ernst ..... A47L 13/16 248/231.9
2009/0282706 A1 11/2009 Barker et al.
2009/0308623 A1 12/2009 Koch et al.

* cited by examiner

METHOD AND APPARATUS FOR INSTALLING CUTTING EDGES ON A V-BLADE PLOW

RELATED APPLICATIONS

This application is a divisional of U.S. patent application Ser. No. 13/777,480 filed Feb. 26, 2013, which is hereby incorporated by reference herein as if fully set forth in its entirety.

FIELD OF THE INVENTION

This invention relates generally to plows and more particularly to vehicle mountable snow plows having a V-blade configuration.

BACKGROUND OF THE INVENTION

Vehicle mounted snow plows currently in use are generally of either the single straight blade variety, or of the center-hinged dual blade variety known as V-blade plows, or simply V-plows. A single straight blade plow can be oriented either generally perpendicular to the longitudinal axis of the vehicle so as to push snow straight ahead, or pivoted towards the passenger side of the vehicle or the driver side of the vehicle as desired so as to push snow to the desired side of the vehicle. In addition to these configurations, a V-blade plow can pivot its dual blades relative to each other, permitting a rearward sweeping V-shaped configuration that pushes snow simultaneously to both the passenger and driver sides of the vehicle, and permitting a forward sweeping V-shaped configuration (also known as the "scoop" configuration) for scooping snow and pushing it forward.

Both varieties of plow employ a consumable or sacrificial cutting edge which generally takes the form of a rectangular plate that is bolted to the lower edge of the plow blade. The cutting edge contacts the pavement surface being plowed with a scraping action. Consequently, the cutting edge must be periodically replaced as it wears away. Employing the use of a replaceable cutting edge thus prevents the entire plow blade from having to be replaced, resulting in a significant cost savings.

One disadvantage of V-blade plows is that due to the nature of the hinge connection of the dual blades, there is a gap between the inboard ends of the respective cutting edges of the dual blades which results in a strip of unplowed snow being left behind as the vehicle moves forward. Sometimes this gap can become excessive. This is due to the manufacturing tolerances of the various parts of the plow assembly creating in a production environment a "tolerance stack-up" at one extreme end of the spectrum.

The tolerances of the parts have to be such that the parts are economically feasible to produce, while assuring that, at the other extreme end of the tolerance stack-up spectrum, there are no interference issues between the inboard ends of the cutting edges during the full extent of travel of the V-blades relative to each other, in order to avoid damage to the cutting edges and associated structure of the plow assembly. While the tolerances of the various parts could always be reduced so as to reduce the gap mentioned above while also avoiding interference issues, the various parts become more expensive to produce to the tighter tolerances, and fitment issues are likely to crop up amongst the various parts as well.

Accordingly, there is a need for a V-blade plow and associated cutting edges that a) assures that the gap between the cutting edges is kept as small as practicable on a repeatable basis, while at the same time b) assuring that there is no interference between the cutting edges on a repeatable basis.

SUMMARY OF THE INVENTION

In one aspect, for a V-plow having a pair of plow blades hinged together along inboard ends of the blades at a hinge, and a gauge on a lower end of the hinge having a spacer, the spacer having a thickness in a direction generally transverse to a longitudinal axis of the V-plow corresponding to a desired minimum spacing between inboard ends of a pair of cutting edge plates to be installed on the blades, a method of installing the cutting edge plates on the blades is provided.

The method comprises positioning one of the cutting edge plates along a lower edge of one of the blades so that the inboard end of the one cutting edge plate abuts one side of the spacer, securing the one cutting edge plate to the one blade, positioning the other cutting edge plate along a lower edge of the other blade so that the inboard end of the other cutting edge plate abuts the other side of the spacer, and securing the other cutting edge plate to the other blade.

The method can further comprise the step of removing the gauge from the hinge after the cutting edge plates have been secured to the blades. The method can further comprise the step of positioning the blades into a rearward sweeping V-shaped configuration before the cutting edge plates are positioned along the lower edges of the blades. The step of positioning the cutting edge plates along the lower edges of the blades can further comprise passing bolts through holes in the cutting edge plates and through slots in the blades and hand tightening nuts onto the bolts. The step of positioning the inboard ends of the cutting edge plates to abut the sides of the spacer can further comprise sliding the cutting edge plates on the blades and sliding the bolts in the slots until the inboard ends of the cutting edge plates contact the sides of the spacer. The step of securing the cutting edge plates to the blades can further comprise tightening the nuts onto the bolts with a tool.

In another aspect, for a V-plow having a pair of plow blades hinged together along inboard ends of the blades at a hinge, a method of installing a pair of cutting edge plates on the blades is provided.

The method comprises attaching a gauge on a lower end of the hinge, the gauge having a spacer having a thickness in a direction generally transverse to a longitudinal axis of the V-plow corresponding to a desired minimum spacing between inboard ends of the pair of cutting edge plates, positioning one of the cutting edge plates along a lower edge of one of the blades so that the inboard end of the one cutting edge plate abuts one side of the spacer, securing the one cutting edge plate to the one blade, positioning the other cutting edge plate along a lower edge of the other blade so that the inboard end of the other cutting edge plate abuts the other side of the spacer, and securing the other cutting edge plate to the other blade.

The step of attaching the gauge on the lower end of the hinge can further comprise permanently or removably attaching the gauge to the lower end of the hinge. If removable, the method can further comprise the step of removing the gauge from the hinge after the cutting edge plates have been secured to the blades.

In another aspect, A V-plow is provided. The V-plow comprises a pair of plow blades hinged together along inboard ends of the blades at a hinge, a pair of cutting edge plates, one of which is attached to a lower edge of one of the blades and the other of which is attached to a lower edge of the other blade, and a gauge on a lower end of the hinge, the gauge having a spacer having a thickness in a direction generally transverse to a longitudinal axis of the V-plow corresponding to a desired minimum spacing between inboard ends of the pair of cutting edge plates, the one cutting edge plate positioned such that the inboard end of the one cutting edge plate abuts one side of the spacer, and the other cutting edge plate positioned such that the inboard end of the other cutting edge plate abuts the other side of the spacer.

The inboard ends of the cutting edge plates preferably contact their respective sides of the spacer when the blades are positioned in a rearward sweeping V-shaped configuration. The cutting edge plates can be attached to the blades with bolts passing through holes in the cutting edge plates and through slots in the blades and with nuts tightened on the bolts. The lowermost edge of the spacer can be spaced above a lowermost edge of each cutting edge plate so as to avoid obstructions that would be struck by the lowermost edges of the cutting edge plates during plowing. The forward edge of the spacer can be angled or curved to assist the spacer in riding over an obstruction in the event that the obstruction is tall enough to be struck by the spacer. For example, the forward edge of the spacer can be angled or curved downwardly and rearwardly. For example, the spacer can be fin shaped. The gauge can be permanently or removably attached to the lower end of the hinge. The thickness of the spacer can be about 0.125 inch, for example. Each cutting edge plate can have a first planar portion and a second planar portion, wherein the first planar portion extends along a front of the lower edge of a respective one of the blades, and the second planar portion extends rearwardly from the first planar portion and inwardly toward a pivot axis of the hinge.

In another aspect, for a V-plow having a pair of plow blades hinged together along inboard ends of the blades at a hinge, a gauge adapted to be installed on a lower end of the hinge for spacing inboard ends of a pair of cutting edge plates to be installed on the blades is provided. The gauge comprises a base plate having a hinge pin clearance hole and a pair of mounting holes for receiving bolts for removably attaching the gauge to the lower end of the hinge, one of the mounting holes being positioned on one side of the hinge pin clearance hole and the other mounting hole being positioned on the other side of the hinge pin clearance hole, and a spacer having a thickness corresponding to a desired minimum spacing between the inboard ends of the pair of cutting edge plates. The spacer has a forward portion connected to an underneath side of the base plate, extends across the hinge pin clearance hole between the pair of mounting holes, and has a rearward portion connected to the underneath side of the base plate.

For example, the forward portion of the spacer can be angled or curved downwardly and rearwardly. As another example, the spacer can be fin shaped. The spacer can have a transverse thickness of about 0.125 inch, for example.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
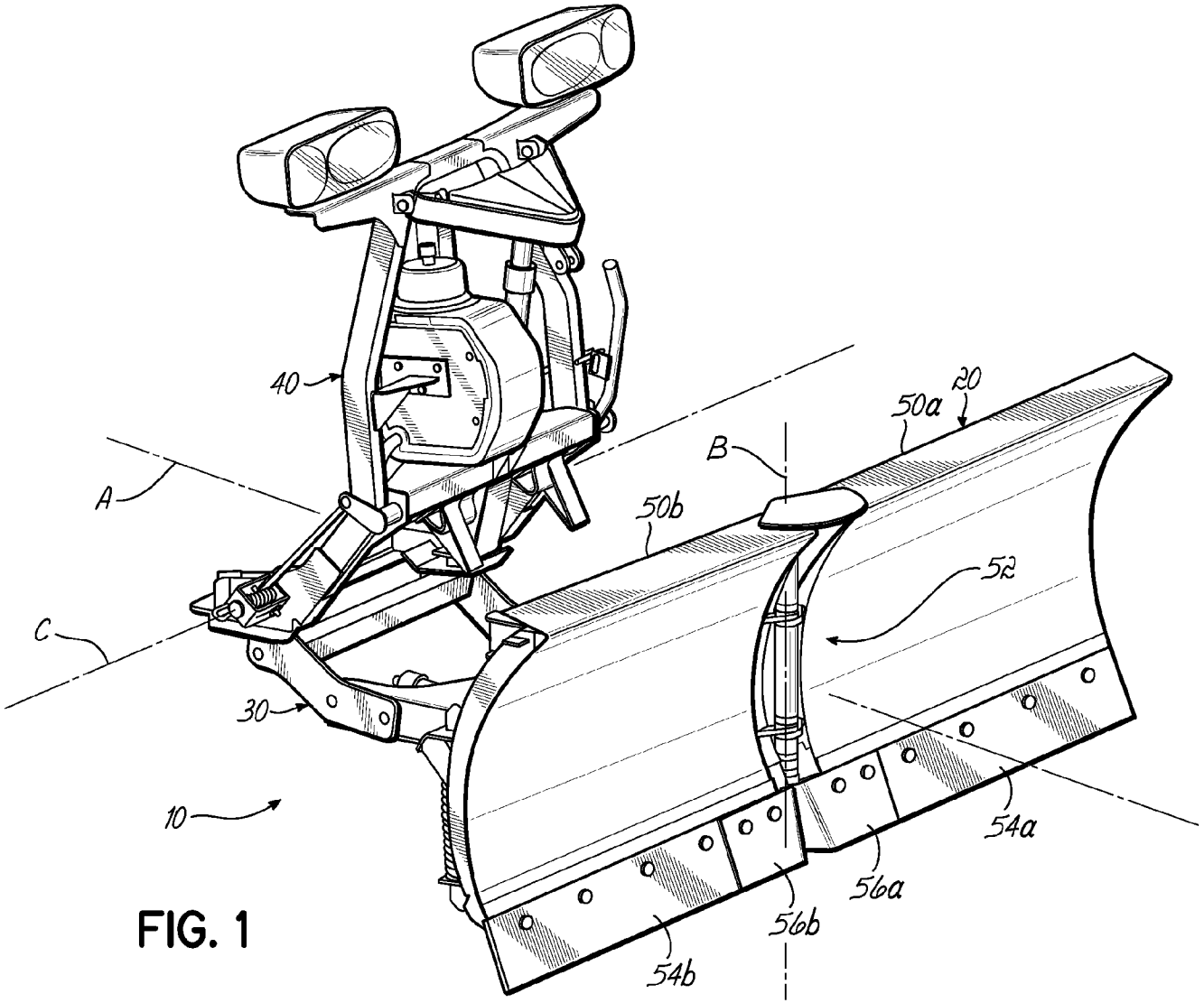
FIG. 1 is a right front perspective view of a V-plow according to the principles of the present invention.
Figure 2:
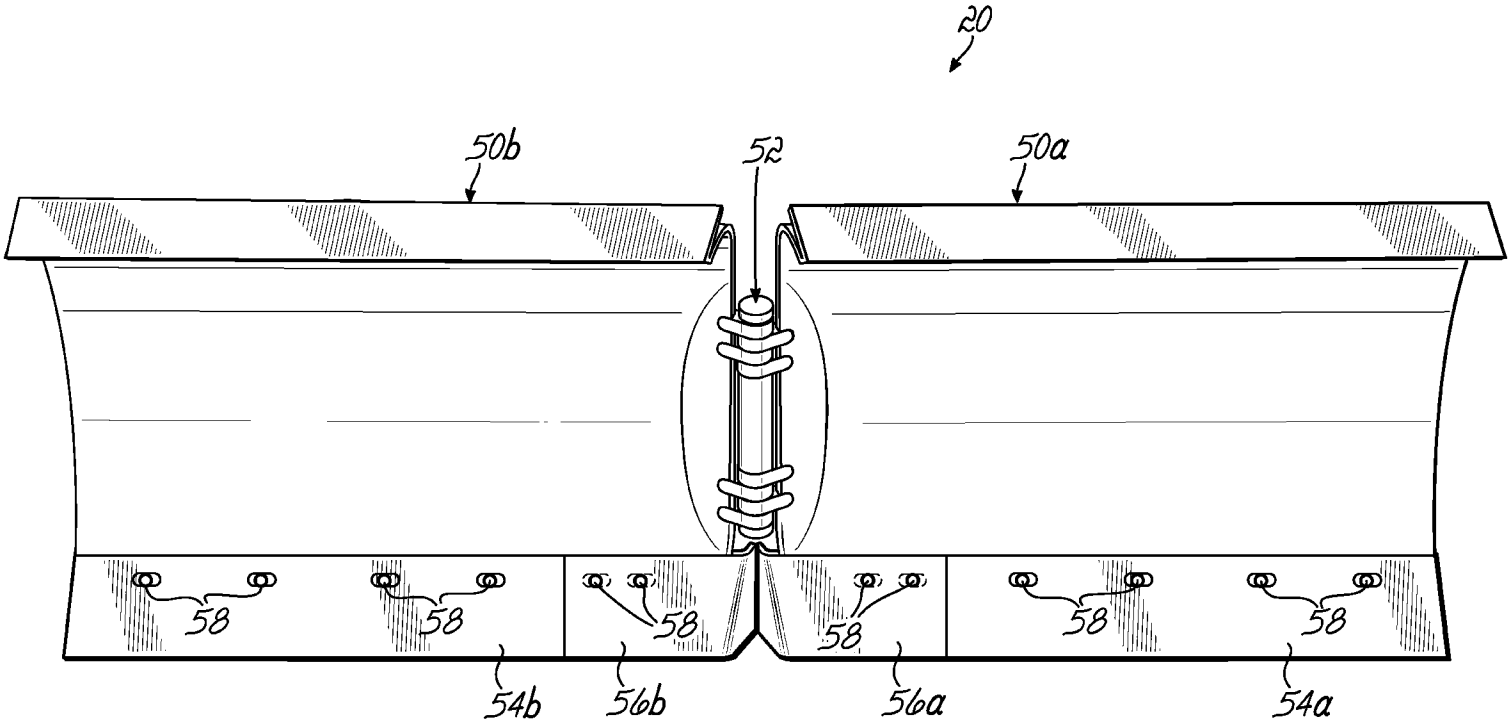
FIG. 2 is a front view of the V-plow of FIG. 1.

Referring first to FIGS. 1 and 2, a V-plow assembly 10 according to the principles of the present invention, and for removable attachment to a vehicle having a longitudinal axis A, is shown. Plow assembly 10 has a V-blade assembly 20, a support frame assembly 30, and a lift frame assembly 40. The V-blade assembly 20 is connected to the support frame assembly 30 on or near a front end of the support frame assembly 30 for pivotal movement relative to the vehicle about a generally vertical axis B as will be subsequently described in more detail. The support frame assembly 30 is pivotally connected to the lift frame assembly 40 on or near a rear end of the support frame assembly 30 for pivotal movement of the support frame assembly 30 relative to the vehicle about a generally horizontal axis C generally transverse to the vehicle longitudinal axis A. The lift frame assembly 40 includes a hydraulic actuator and associated structure for lifting and lowering the support frame assembly 30 and hence V-blade assembly 20. The lower rear end of the lift frame assembly 40 interfaces with a vehicle mount frame assembly (not shown) that is mounted to the frame of the vehicle thereby permitting the snow plow assembly 10 to be removably mounted to the vehicle. For additional details of a suitable support frame assembly 30, lift frame assembly 40, and vehicle mount frame assembly, reference may be had to the assignee's U.S. Pat. No. 6,944,978, hereby incorporated by reference herein as if fully set forth in its entirety.

Figure 6:
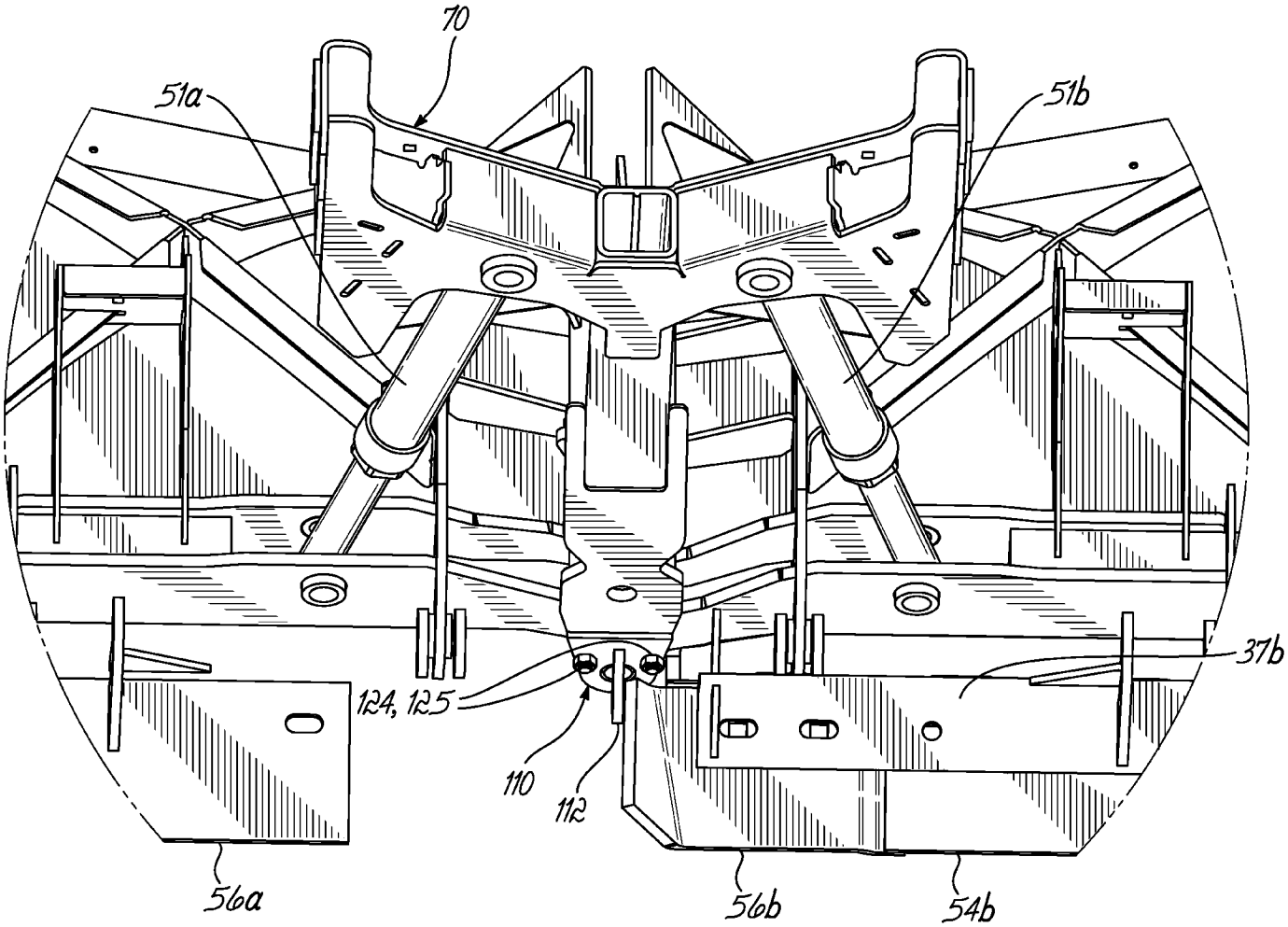
FIG. 6 is an enlarged rear bottom view of the V-blade hinge assembly of FIG. 5.
Figure 8:
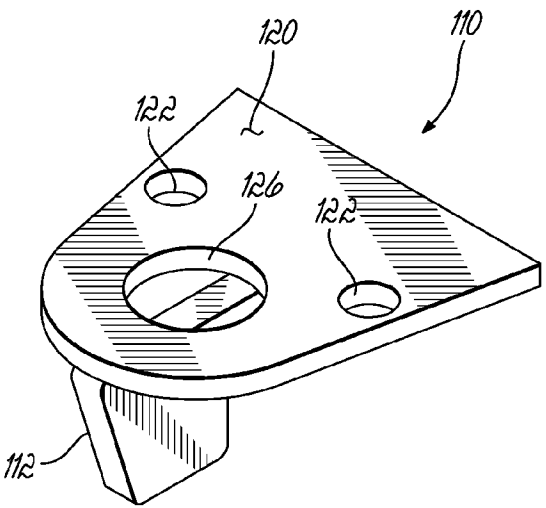
FIG. 8 is a left front top perspective view of a removable V-blade cutting edge plate installation gauge.
Figure 7:
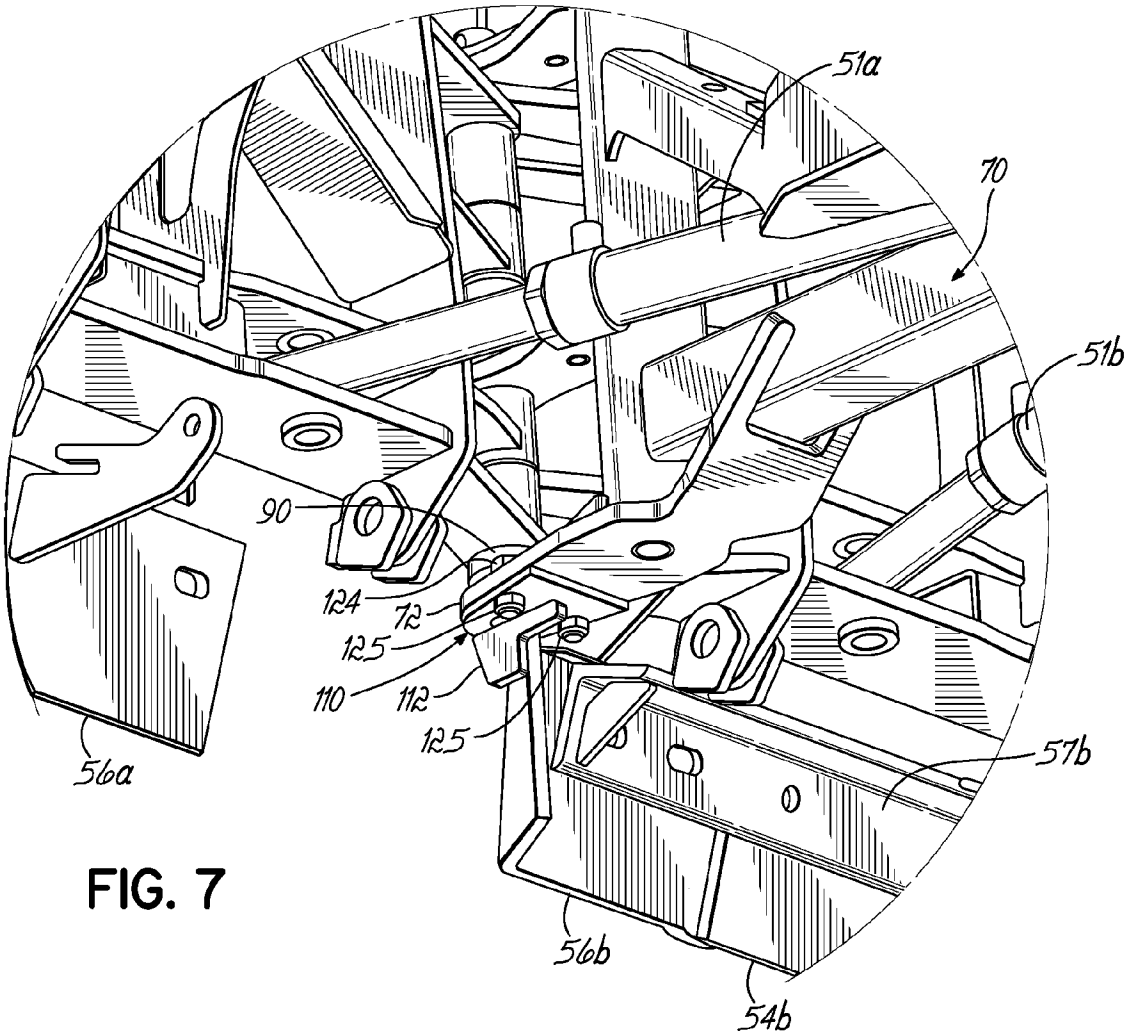
FIG. 7 is an enlarged left rear bottom perspective view of the V-blade hinge assembly of FIG. 5.
Figure 11:
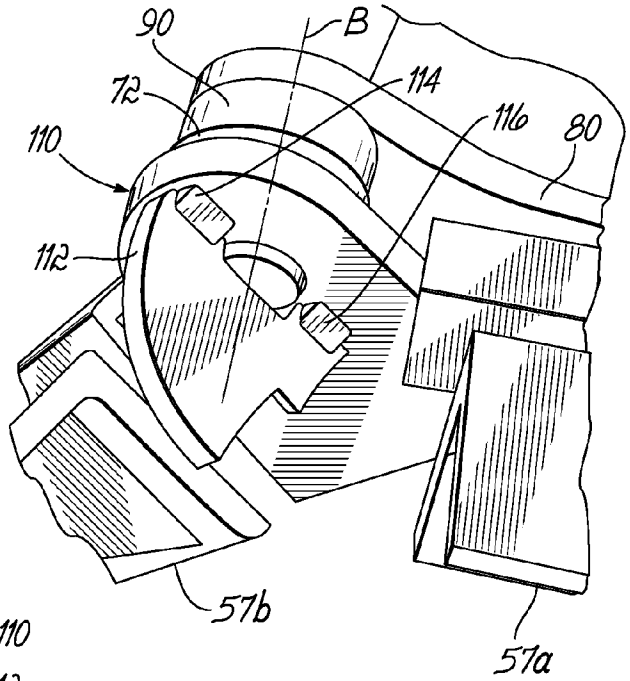
FIG. 11 is a left front bottom perspective view of the permanent V-blade cutting edge plate installation gauge of FIG. 9.
Figure 10:
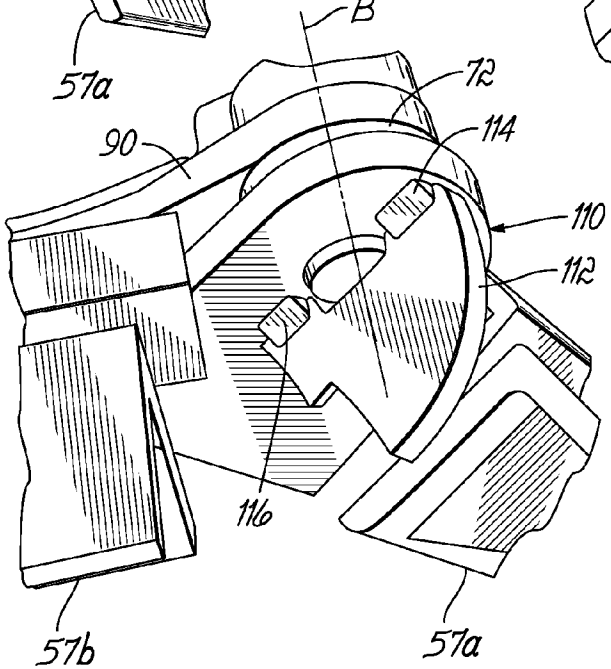
FIG. 10 is a right front bottom perspective view of the permanent V-blade cutting edge plate installation gauge of FIG. 9.
Figure 9:
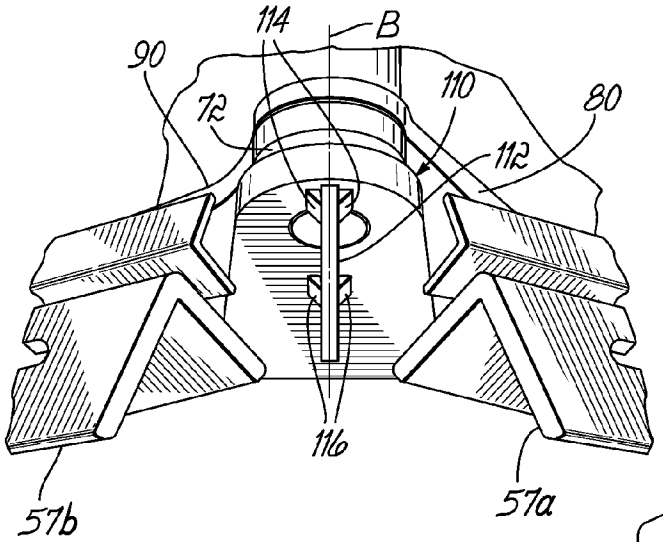
FIG. 9 is a front bottom view of a permanent V-blade cutting edge plate installation gauge.
Figure 12:
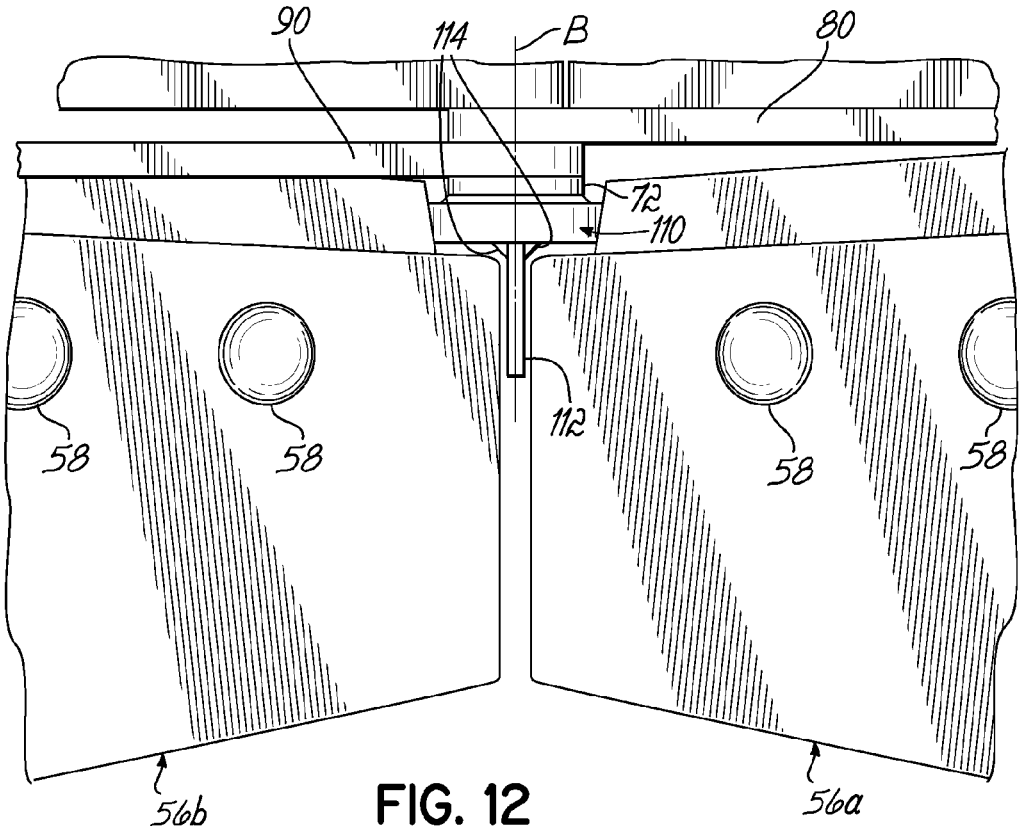
FIG. 12 is a front view of the permanent V-blade cutting edge plate installation gauge and cutting edge plates with the V-blades in the forward sweeping scoop configuration.
Figure 13:
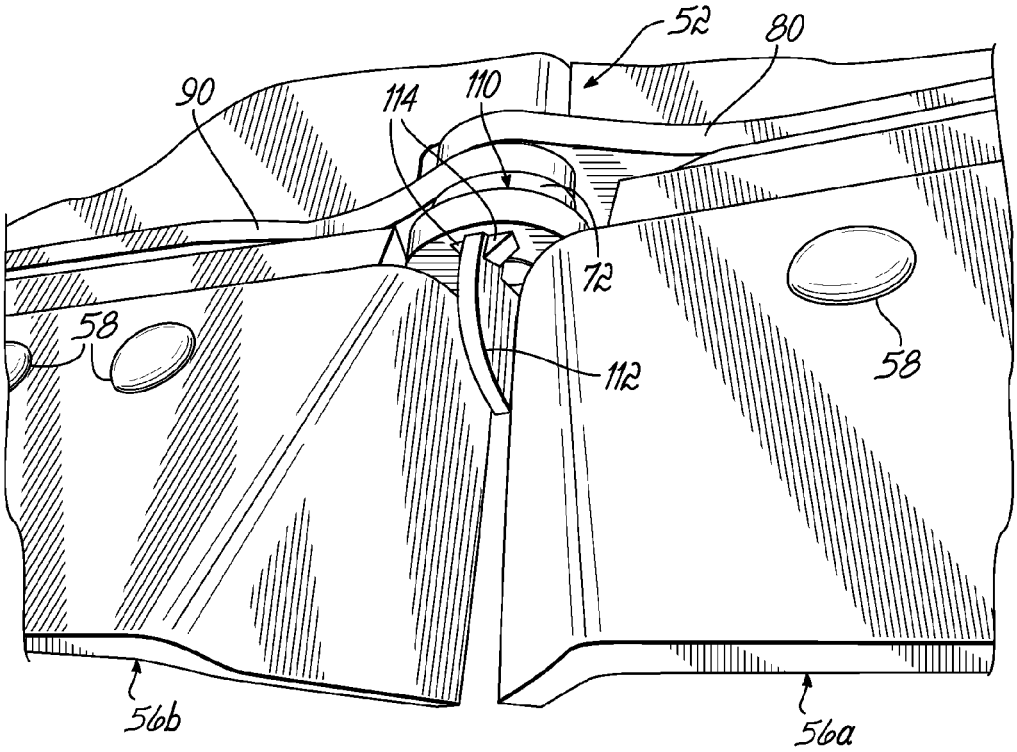
FIG. 13 is a left front bottom perspective view of the permanent V-blade cutting edge plate installation gauge and cutting edge plates with the V-blades in the straight blade configuration.
Figure 14:
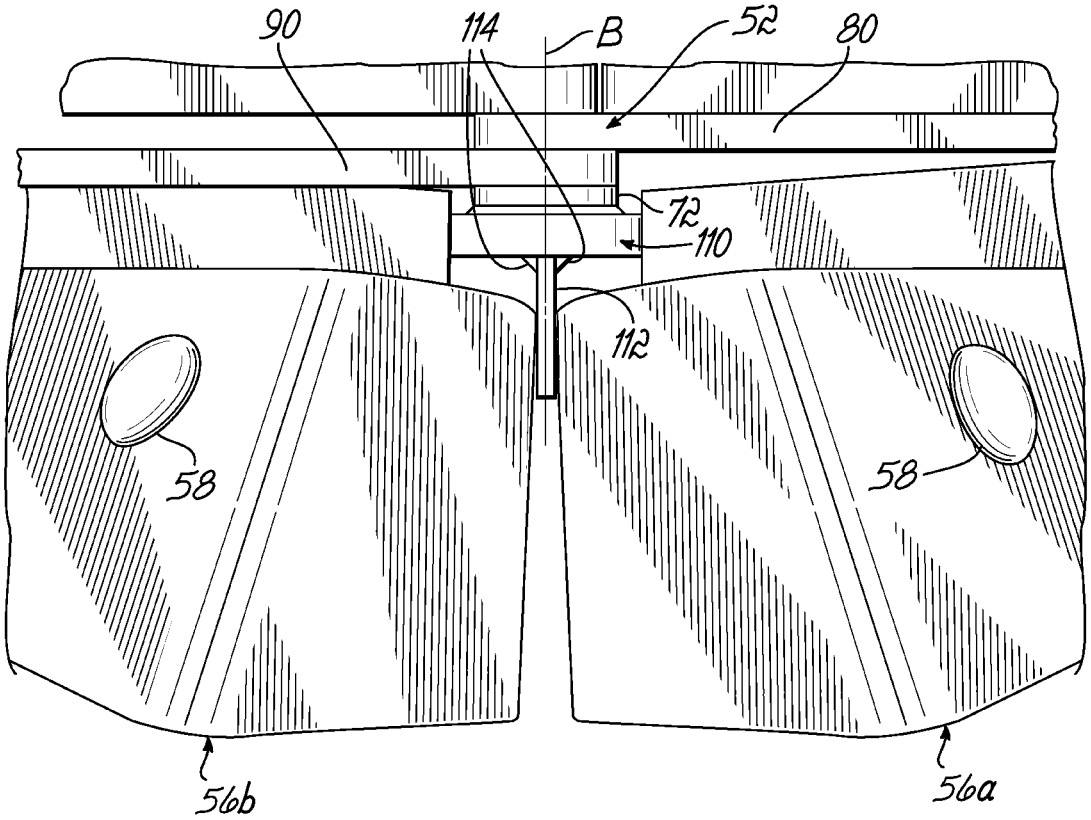
FIG. 14 is a front view of the permanent V-blade cutting edge plate installation gauge and cutting edge plates with the V-blades in the rearward sweeping V configuration.

The V-blade assembly 20 comprises a pair of blades 50*a*, 50*b* hinged together along inboard ends thereof as at hinge assembly 52 for pivotal movement relative to one another and the vehicle about the generally vertical axis B of the hinge assembly 52. Each blade 50*a*, 50*b* is actuated by its own hydraulic actuator 51*a*, 51*b*, respectively (FIG. 6) operable between the respective blade 50*a*, 50*b* and the support frame assembly 30. Accordingly, the V-blade assembly 20 is able to assume a straight blade configuration, a rearward sweeping V-shaped configuration, and a forward sweeping V-shaped scoop configuration.

Referring now to FIGS. 4-7, hinge assembly 52 is supported by or is otherwise formed as a part of a T-frame 70 which itself forms a part of the support frame assembly 30. For example, hinge assembly 52 can be formed by hinge lugs 72, 74, and 76 on the T-frame 70, hinge leaves 80, 82, 84, and 86 on left hand (driver side) blade 50*a*, hinge leaves 90, 92, 94, and 96 on right hand (passenger side) blade 50*b*, and hinge pin 100.

Figure 3:
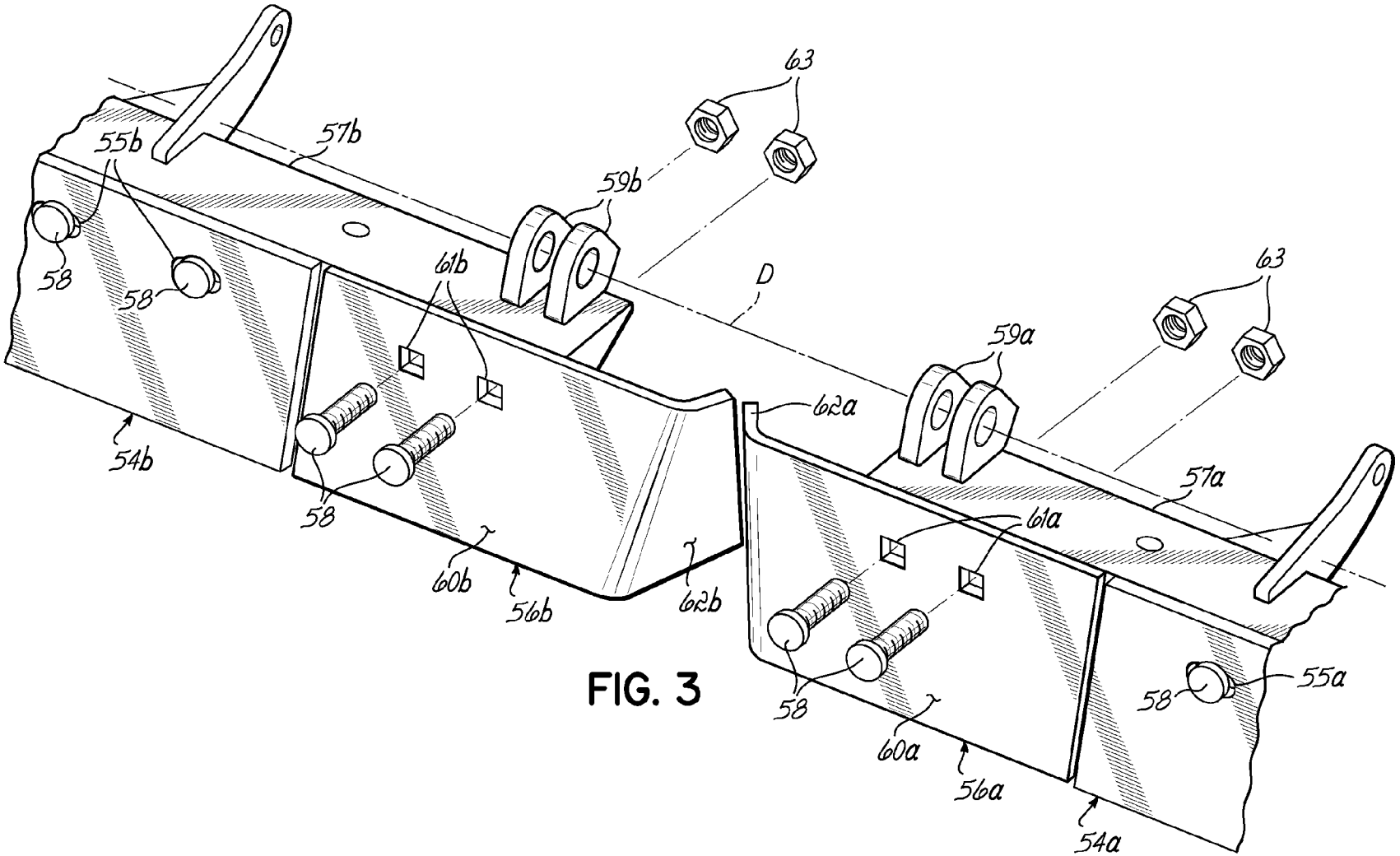
FIG. 3 is an enlarged partial left front perspective view of the center cutting edge plates of the V-plow of FIGS. 1 and 2.
Figure 4:
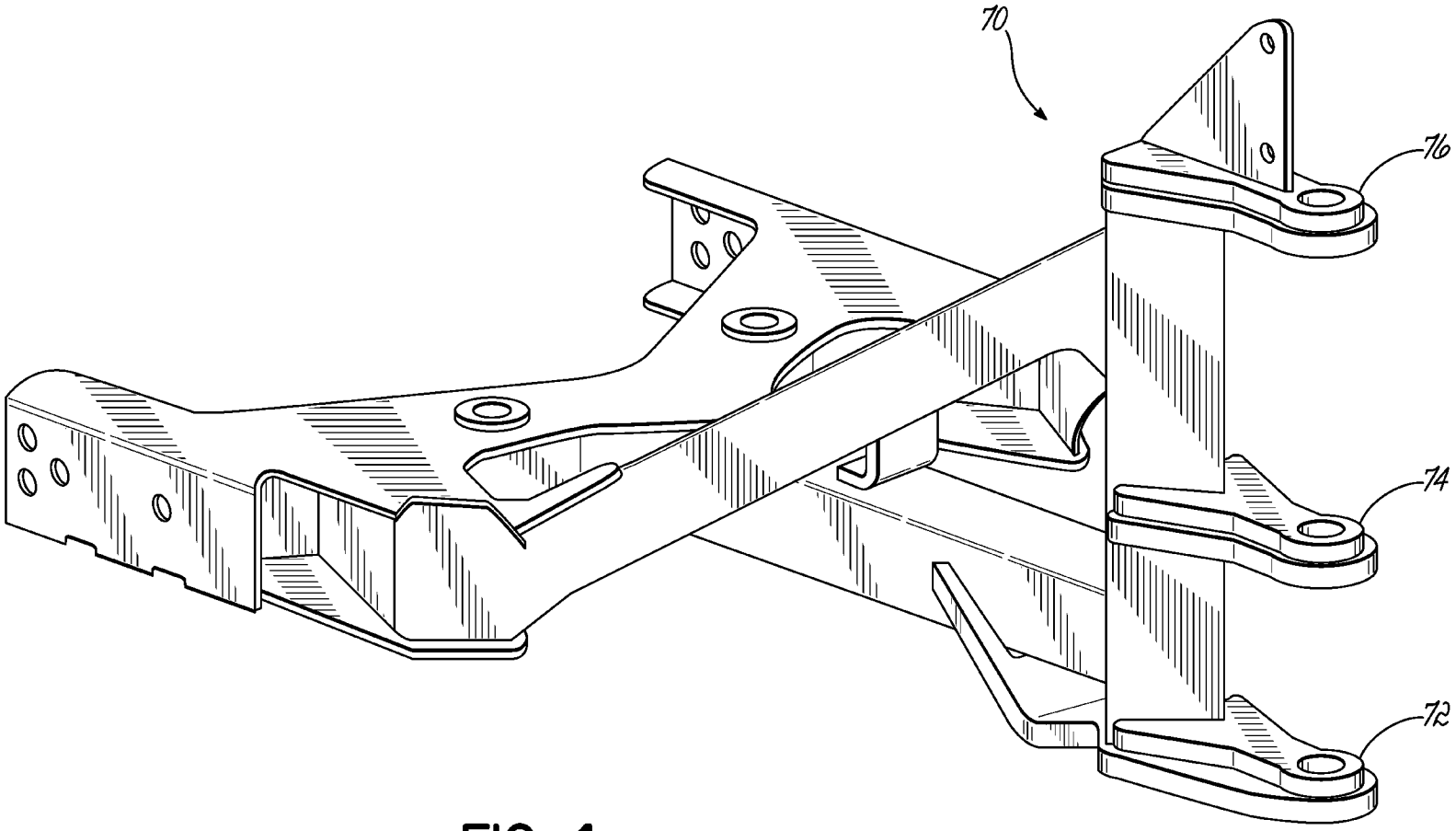
FIG. 4 is a right front perspective view of the T-frame portion of the support frame assembly.
Figure 5:
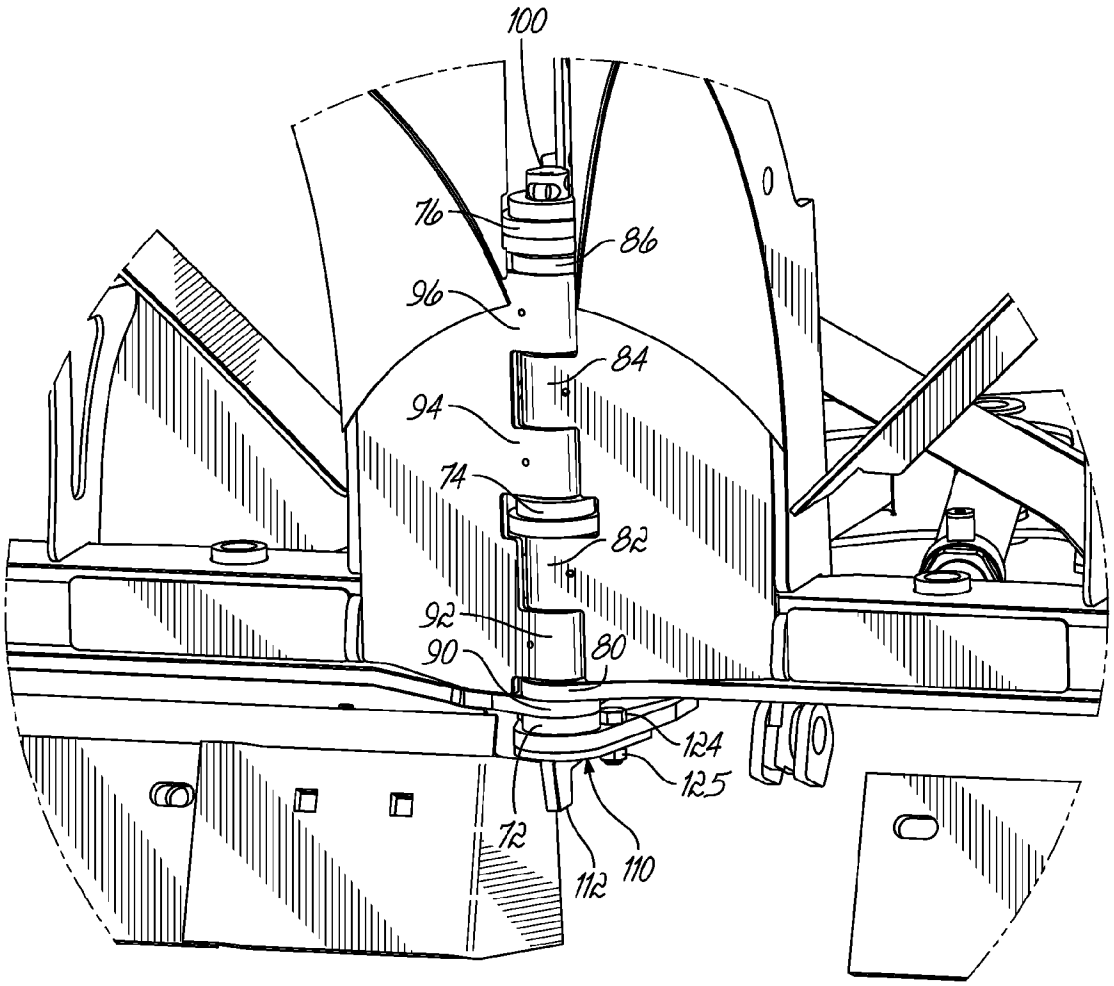
FIG. 5 is an enlarged left front perspective view of the V-blade hinge assembly with moldboards removed from the V-blades.

Referring now back to FIGS. 1-3, left hand blade 50*a* includes a first outboard cutting edge plate 54*a* and a second inboard or center cutting edge plate 56*a* removably secured thereto, and similarly, right hand blade 50*b* includes a first outboard cutting edge plate 54*b* and a second inboard or center cutting edge plate 56*b* removably secured thereto. It is contemplated that the cutting edge plates can be either directly or indirectly attached to the blades and be within the scope of the present invention. In other words, all that is required is that the cutting edge plates be operably connected to the blades in some manner.

For example, and as illustrated, cutting edge plates 54*a*, 56*a* can be indirectly attached to blade 50*a* by virtue of being removably secured to a "trip" cutting edge mounting structure 57*a* via bolts 58 and nuts 63, and cutting edge plates 54*b*, 56*b* can be indirectly attached to blade 50*b* by virtue of being removably secured to a "trip" cutting edge mounting structure 57*b* also via bolts 58 and nuts 63. The trip cutting edge mounting structures 57*a*, 57*b* can be, for example, angle sections. Angle sections 57*a*, 57*b* can in turn be pivotally attached to their respective blade 50*a*, 50*b* (or blade supporting frame) as by suitable bolts, pins, or the like (not shown) passing through holes in mounting lugs 59*a*, 59*b* on the angle sections 57*a*, 57*b*, respectively, and through holes in cooperating mounting lugs (not shown) on the blades 50*a*, 50*b* (or blade supporting frame).

This arrangement permits the cutting edge plates to "trip," i.e. pivot backward (typically against spring bias) about a generally horizontal axis D generally transverse to the vehicle longitudinal axis A, up and over, obstacles encountered during plowing. Such a configuration is typically referred to in the industry as an "edge trip." This is in contrast to what is referred to in the industry as a "blade trip," wherein the cutting edge plates are fixedly (i.e. non-pivotally) attached to the blade (or blade supporting frame) and the entire blade is pivotally mounted relative to the support frame assembly about a generally horizontal axis generally transverse to the vehicle longitudinal axis, which allows the entire blade to pivot backward against spring bias up and over obstacles encountered during plowing. In any event, the phrases "attached to the blade," "secured to the blade," "mounted to the blade," "connected to the blade," or similar language, when referring to the cutting edge plates, shall be deemed to generically embrace both direct mounting to the blade, as well as indirect mounting to the blade, such as mounting to the pivoting trip cutting edge mounting structure or mounting to the blade supporting frame or the like.

As mentioned above, the first cutting edge plates 54*a*, 54*b* are mounted to their respective blades outboard of the second or center cutting edge plate 56*a*, 56*b*, respectively. Preferably the outboard cutting edge plates 54*a*, 54*b* include slots 55*a*, 55*b*, respectively, for the bolts 58 and the underlying mounting structure 57*a*, 57*b* includes holes for the bolts 58, whereas preferably the inboard or center cutting edge plates 56*a*, 56*b* include holes 61*a*, 61*b*, respectively, for the bolts 58 and the underlying mounting structure 57*a*, 57*b* includes slots for the bolts 58. Note, however, that the center cutting edge plates 56*a*, 56*b* could include slots and the mounting structure 57*a*, 57*b* could include holes, or the center cutting edge plates 56*a*, 56*b* could include a combination of holes and slots and the mounting structure 57*a*, 57*b* could include a combination of holes and slots. Nuts 63 are in turn threaded onto the bolts 58 to secure the cutting edge plates in place. Using two cutting edge plates for each blade allows the cutting edge plates to be made of two different materials, which can be advantageous from a cost and wear standpoint. For example, outer cutting edge plates 54*a*, 54*b* can be fabricated of harder AISI 1080-1084 and the inner (center) cutting edge plates 56*a*, 56*b* can be fabricated of softer ASTM A572 Grade 50. See the assignee's US Patent Application Publication No. 2009/0282706, hereby incorporated by reference herein as if fully set forth in its entirety, for a discussion of the advantages of using two separate cutting edge plates fabricated of materials having two different hardnesses, as well as a discussion of various other suitable materials. Notwithstanding, two separate cutting edge plates for each blade are not required for the practice of the invention. Accordingly, the term "cutting edge plate" shall be deemed to generically embrace both a cutting edge plate that extends the full length of the blade, as well as an inboard-most or center cutting edge plate that extends only partially the length of the blade. Additionally, the term "cutting edge plate" shall also be deemed to embrace only that portion that extends rearwardly from an inboard edge of the blade and inwardly toward the hinge axis of the V-blades.

Referring to FIG. 3, the second cutting edge plate 56*a* mounted on blade 50*a* can have a first planar portion 60*a* and a second planar portion 62*a*, with the first planar portion 60*a* mounted to the front lower edge of blade 50*a* (or corresponding trip structure or blade frame), and with the second planar portion 62*a* extending rearwardly from the first planar portion 60*a* and inwardly toward the pivot axis B of the hinge assembly 52. Similarly, the second cutting edge plate 56*b* mounted on blade 50*b* can have a first planar portion 60*b* and a second planar portion 62*b*, with the first planar portion 60*b* mounted to the front lower edge of blade 50*b* (or corresponding trip structure or blade frame), and with the second planar portion 62*b* extending rearwardly from the first planar portion 60*b* and inwardly toward the pivot axis B of the hinge assembly 52. For suitable geometries, associated dimensions, and the like for the first and second planar portions of the cutting edge plates, again refer to the assignee's '706 patent publication.

Referring now to FIGS. 6-14, a gauge 110 (FIG. 8) can be either removably attached (FIGS. 5-7) or permanently attached (FIGS. 9-14) to a lower end of the hinge assembly 52 to assist in installing the center cutting edge plates 56*a*, 56*b* to the blades 50*a*, 50*b*. More particularly, gauge 110 includes a spacer 112. The spacer 112 has a thickness in a direction generally transverse to the longitudinal axis A of the vehicle (and hence generally transverse to the longitudinal axis of the V-plow) corresponding to a desired minimum spacing between inboard ends of the inner or center cutting edge plates 56*a*, 56*b*. A suitable spacing has been found to be about ⅛ inch (about 0.125 inch). Spacer 112 could simply be welded to the underneath side of lowermost hinge lug 72 as at 114 and 116 shown in FIGS. 9-11 to effect permanent installation.

Alternatively, spacer 112 could be temporarily or removably installed. More particularly, spacer 112 could be provided with a base plate 120 including a pair of clearance bolt holes 122, 122 which accept bolts 124 that extend through clearance holes in the lowermost hinge lug 72 and that are secured with nuts 125. Base plate 120 could further include a hinge pin clearance hole 126 so as to avoid any interference or binding with hinge pin 100. Preferably, a lowermost edge of the spacer 112 is spaced well above a lowermost edge of each cutting edge plate 56*a*, 56*b* so as to avoid obstructions that would be struck by the lowermost edges of the cutting edge plates 56*a*, 56*b* during plowing. The forward edge of the spacer 112 is preferably curved or sloped or slanted or angled downwardly and rearwardly to assist the spacer 112 in riding over an obstruction in the event that the obstruction is tall enough to be struck by the spacer 112 during plowing. For example, the spacer 112 can advantageously sweep downwardly and rearwardly so as to be roughly in the shape of a "fin." Other shapes are of course suitable however. Examples of a suitable height and length (i.e. fore and aft dimension or dimension parallel to the vehicle longitudinal axis) of spacer 112 are about 1.5 inches high and about 3.0 inches long. Other dimensions both greater and lesser than those specified can be used for the height and length of spacer 112.

In use, the gauge of the present invention can be utilized by an original equipment manufacturer ("OEM"), a distributor/dealer, or an end user to properly install cutting edge plates on a V-plow. With the gauge installed by being either temporarily or permanently attached to the hinge assembly, the blades are first typically, though not necessarily, positioned in their rearward sweeping V configuration, as this is the position that typically places the inboard ends of the cutting edges closest together. Due to variations in V-plow configurations, hinge geometry, etc., however, the blades may need to initially be placed in some other configuration, i.e. in straight blade configuration or in the forward sweeping scoop V configuration, or in some other position between rearward V, straight, and forward V, to place the blades in the position that will cause the inboard ends of the cutting edges to be closest together. The cutting edge plates are then initially attached to the blades with bolts and nuts, the nuts being merely hand tightened on the bolts. Then the cutting edge plates are simply slid inwardly until each contacts the spacer on the gauge. Next the nuts are fully tightened on the bolts with a tool such as a wrench or the like. Finally, if the gauge is of the removable variety, it is removed from the hinge assembly.

Making the gauge spacer about 0.125 inch wide provides a good trade-off between avoiding interference between the inboard ends of the cutting edge plates, on the one hand, while preventing the gap between the inboard ends of the cutting edge plates from becoming excessive, on the other hand, during the full range of motion of the V-blades. Gauge spacer widths both greater than and lesser than 0.125 inch could be used and provide acceptable results, and are within the scope of the invention. Moreover, use of the gauge of the present invention allows a manufacturer to assure a near uniform fairly small gap between the inboard ends of the cutting edge plates during the full range of motion of the V-blades, while using standard manufacturing tolerances. Overly tight tolerances are thus not required. A manufacturer is thereby able to avoid the additional expense of fabricating the various parts to tighter tolerances, as well as the fitment headaches that are sure to arise when tolerances are tightened.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. Accordingly, the scope of the invention shall be limited only by the following claims and their equivalents.

What is claimed is:

1. For a V-plow having a pair of plow blades hinged together along inboard ends of the blades at a hinge having a generally vertical axis, a gauge adapted to be installed on a lower end of the hinge for spacing inboard ends of a pair of cutting edge plates to be installed on the blades, the gauge comprising:

a generally horizontally oriented base plate having a hinge pin clearance hole and a pair of mounting holes for receiving bolts for removably attaching the gauge to the lower end of the hinge, one of the mounting holes being positioned on one side of the hinge pin clearance hole and the other mounting hole being positioned on the other side of the hinge pin clearance hole, and a spacer oriented generally perpendicularly to the base plate and having a thickness corresponding to a desired minimum spacing between the inboard ends of the pair of cutting edge plates, the spacer having a forward portion fixedly connected to an underneath side of the base plate, the spacer extending across the hinge pin clearance hole between the pair of mounting holes, and the spacer having a rearward portion fixedly connected to the underneath side of the base plate.

2. The gauge of claim 1 wherein the forward portion of the spacer angles or curves downwardly and rearwardly.

3. The gauge of claim 1 wherein the spacer is fin shaped in that the spacer is relatively thin in comparison to its length and height, is generally flat, and sweeps downwardly and rearwardly.

4. The gauge of claim 1 wherein the spacer has a transverse thickness of about 0.125 inch.

5. For a V-plow having a pair of plow blades hinged together along inboard ends of the blades at a hinge having a generally vertical axis, a gauge adapted to be installed on a lower end of the hinge for spacing inboard ends of a pair of cutting edge plates to be installed on the blades, the gauge comprising:

a generally vertically oriented spacer having a thickness corresponding to a desired minimum spacing between the inboard ends of the pair of cutting edge plates, the spacer having a forward portion fixedly connected to a lowermost hinge lug of the hinge, the spacer having a rearward portion fixedly connected to the lowermost hinge lug of the hinge, the spacer extending across a hinge pin of the hinge, and the spacer having a recess between the forward portion and the rearward portion providing clearance for the hinge pin.

6. The gauge of claim 5 wherein the forward portion of the spacer angles or curves downwardly and rearwardly.

7. The gauge of claim 5 wherein the spacer is fin shaped in that the spacer is relatively thin in comparison to its length and height, is generally flat, and sweeps downwardly and rearwardly.

8. The gauge of claim 5 wherein the spacer has a transverse thickness of about 0.125 inch.

9. The gauge of claim 5 wherein the spacer is a generally flat plate lying in a plane defined by the vertical hinge axis and a longitudinal axis of the V-plow, is relatively thin in comparison to its length and height, and has a convex curved edge that sweeps downwardly and rearwardly from the forward portion to a point below the vertical hinge axis.

10. The gauge of claim 5 wherein the spacer is welded to the lowermost hinge lug of the hinge.

* * * * *